US007843117B2

(12) United States Patent
Jaffrezic et al.

(10) Patent No.: US 7,843,117 B2
(45) Date of Patent: Nov. 30, 2010

(54) PLASMA-GENERATING PLUG

(75) Inventors: Xavier Jaffrezic, Velizy (FR); Andre Agneray, Boulogne Billancourt (FR)

(73) Assignee: Renault S.A.S., Boulogne Billancourt (FR)

( * ) Notice: Subject to any disclaimer, the term of this patent is extended or adjusted under 35 U.S.C. 154(b) by 283 days.

(21) Appl. No.: 11/814,855

(22) PCT Filed: Jan. 26, 2006

(86) PCT No.: PCT/FR2006/050061

§ 371 (c)(1),
(2), (4) Date: Jun. 18, 2008

(87) PCT Pub. No.: WO2006/079753

PCT Pub. Date: Aug. 3, 2006

(65) Prior Publication Data

US 2009/0033194 A1 Feb. 5, 2009

(30) Foreign Application Priority Data

Jan. 26, 2005 (FR) ..... 05 00777

(51) Int. Cl.
*H01T 13/00* (2006.01)

(52) U.S. Cl. ..... 313/145

(58) Field of Classification Search ..... 313/118–145
See application file for complete search history.

(56) References Cited

U.S. PATENT DOCUMENTS

| | | | | |
|---|---|---|---|---|
| 2,605,755 | A * | 8/1952 | Secrist | 313/11.5 |
| 2,902,747 | A | 9/1959 | Reiter | |
| 3,345,532 | A * | 10/1967 | Mattarella | 313/143 |
| 3,883,762 | A * | 5/1975 | Harris et al. | 313/130 |
| 4,490,122 | A * | 12/1984 | Tromeur | 445/7 |
| 4,841,925 | A | 6/1989 | Ward et al. | |
| 5,731,654 | A * | 3/1998 | Benedikt et al. | 313/131 A |

FOREIGN PATENT DOCUMENTS

| | | |
|---|---|---|
| DE | 3616640 | 11/1987 |
| DE | 290304 | 5/1991 |

OTHER PUBLICATIONS

U.S. Appl. No. 12/064,472, filed Feb. 22, 2008, Jaffrezic, et al.
U.S. Appl. No. 12/090,722, filed Apr. 18, 2008, Agneray, et al.

* cited by examiner

*Primary Examiner*—Joseph L Williams
*Assistant Examiner*—Andrew J Coughlin
(74) *Attorney, Agent, or Firm*—Oblon, Spivak, McClelland, Maier & Neustadt, L.L.P.

(57) ABSTRACT

The invention relates to a plasma-generating spark plug which undergoes excitation in the radio frequency domain. The invention comprises at least one first metallic electrode (12, 14), an insulator (13), one of which is equipped with a housing (130) in which the other element (13, 14) is mounted with a gap (15, 16) therebetween. The surface of the insulator (13) opposite the first electrode (12, 14) is metalized.

5 Claims, 1 Drawing Sheet

PLASMA-GENERATING PLUG

The invention relates to a plasma-generating plug of the type used for controlled-ignition engines.

Plasma generating plugs are known that undergo excitation in the radiofrequency domain (that is, above 1 MHz) that makes it possible to obtain a wider spark than the conventional plugs. Such a plug (hereinafter called "radiofrequency plasma-generating plug") generates large sparks from small potential differences. FIG. 3 shows such a plug 1 comprising a tubular socket 2, containing a dielectric insulator 3. The socket 2 forms an electrode, normally linked to ground. The insulator 3 comprises a central bore 30 housing a central electrode 4. The insulator 3 separates the electrodes 2, 4 in the area where the distance separating them is the smallest; thus, the sparks formed between the electrodes are guided over the surface of the insulator.

According to a first assembly technique, the parts of the plug are assembled by fitting together. There then remains a gap between them. In particular, there is a gap J1 between the socket 2 and the insulator 3, and a gap J2 between the insulator 3 and the central electrode 4. It can be seen that sparks are propagated in these gaps when the central electrode of the plug is powered with a high voltage at radiofrequencies. This leads to an energy expenditure which is not used in the useful function of the spark which is to ignite the gaseous mixture close to the plug.

Also known is a technique for assembling the electrode of a conventional plug according to which the gap between the electrode and the insulator is filled with a dielectric material such as glass, providing a bond. If such a technique is adopted to fill the gaps J1 and J2, there is a risk of shear stresses appearing between the parts because of the differential thermal expansions. To reduce its stresses, it is possible to choose materials that have relatively similar thermal expansion coefficients.

Moreover, to avoid the formation of carbon deposits on the insulator exposed to the atmosphere in the combustion chamber, it is useful for the insulator to be at a relatively high temperature, for example 400° C. The carbon deposits affect the good operation of the plug, by creating current leakage lines. At this temperature, the carbon deposits are destroyed by pyrolysis. By filling the gaps J1 and J2, the thermal resistances between the parts are reduced. The parts are therefore at more uniform temperatures, normally lower than that desired for the insulator. In practice, the plug is normally screwed by one of the electrodes into the cylinder head of the engine, itself cooled by the circulation of a coolant.

One objective of the invention is to propose a radiofrequency plasma-generating plug with ionization of the air between electrode and insulation eliminated and producing sparks that are fully used in igniting the gases surrounding the plug and whose insulator can have a relatively high operating temperature. Another objective is to have a wide choice in the materials that form the electrodes and the insulator.

With these objectives in mind, the subject of the invention is a radiofrequency plasma-generating plug comprising at least two elements, one of the elements being a first metal electrode and the other element being an insulator, one of the elements comprising a recess into which the other is fitted with a gap. The surface of the insulator facing the first electrode is metallized.

Since the insulator and the electrode are fitted into one another, there is inevitably a contact between the metal coating of the insulator and the electrode. The surfaces facing each other and separated by the gap are therefore at the same potential, which means that the propagation of sparks in this area is avoided. The sparks are therefore entirely generated outside the insulator and are fully used to ignite the surrounding gases. Furthermore, the partial metallization of the insulator makes it possible to reduce the occasional build-up of electrical charges, and therefore improve the resistance of the insulator to arc-over phenomena. The insulator therefore supports higher voltages.

The plug according to the invention also retains the gap between the insulator and the electrode. Thus, the differential expansions do not induce mechanical stresses and the choice of the materials for the electrode and the insulator is not constrained by the wish to avoid the differential expansions. Furthermore, the gap creates a thermal resistance between the insulator and the electrode, which avoids making their temperature uniform. Even though the electrode is cooled by the fact that it is fixed to a solid element of the engine, the insulator is not cooled as intensely and can have a higher temperature, which favors the pyrolysis of any carbon deposits.

In particular, the first electrode is cylindrical and housed in a bore of the insulator. The metallized part is then the bore of the insulator.

In particular, the plug comprises a second electrode surrounding the insulator, the surface of the insulator facing the second electrode being metallized.

The insulator is, for example, made of ceramic.

The invention will be better understood and other features and advantages will become apparent from reading the description given below, the description referring to the appended drawings in which.

Figure 1:
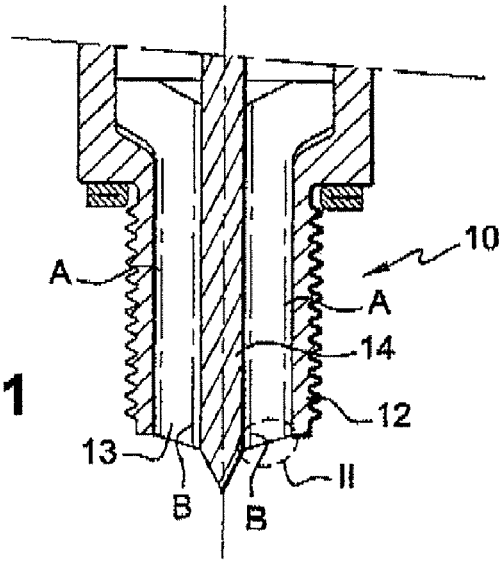
FIG. 1 is a cross-sectional view of a plasma-generating plug according to the invention.
Figure 2:
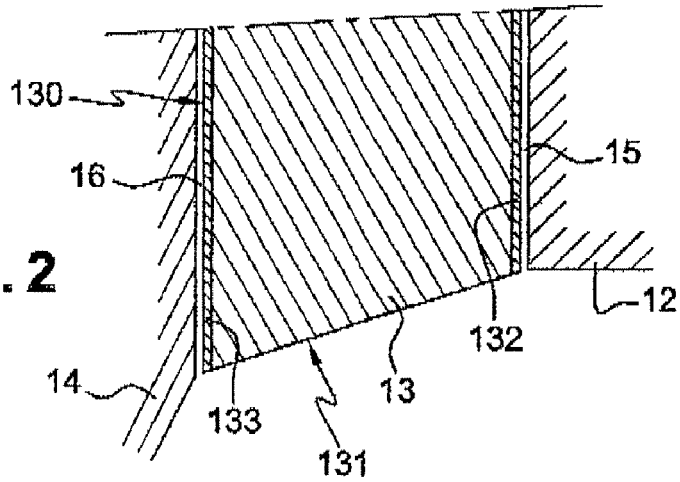
FIG. 2 is a view of detail II of FIG. 1.
Figure 3:
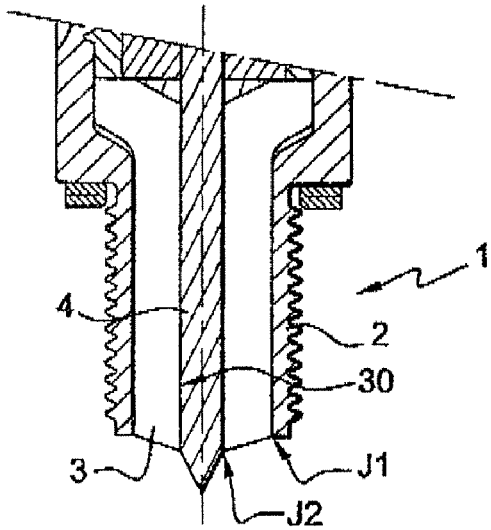
Fig. 3 Prior art
FIG. 3 is a view similar to FIG. 1 of a plug according to the prior art, and described previously.

A radiofrequency plasma-generating plug 10 according to the invention is shown in FIGS. 1 and 2. It comprises, like the plug according to the prior art, a tubular socket 12, containing a dielectric insulator 13. The socket 12 forms an electrode, normally linked to ground. The insulator 13 comprises a central bore 130 housing a central electrode 14.

The insulator is made of ceramic, for example of silicon nitride, but it can be made of glass-ceramic, or of an amorphous material such as quartz.

According to the invention, the insulator 13 has surfaces coated with a metallization. These areas are represented by chain-dotted lines in FIG. 1. A first area A extends over a cylindrical part of the insulator facing the socket 12. A second area B extends inside the bore 130 of the insulator 13 facing the central electrode 14. The truncated-shaped surface 131 of the insulator 13, intended to be exposed in the cylinder of an engine, has no metallization coating.

As can be seen in detail in FIG. 2, a gap 15 is provided between the socket 12 and the insulator 13. Similarly, a gap 16 is provided between the central electrode 14 and the insulator 13. The gaps have a width of the order of a few hundredths to a few tenths of a millimeter. Along the gap 15, the insulator 13 has a first metal layer 132 which extends over all the first area A. Similarly, along the gap 16, the insulator 13 has a second metal layer 133 which extends over all the second area B.

The metal layers 132, 133 are obtained by any conventional ceramic metallization method. For example, metallic salts are deposited on the areas A, B of the insulator 13, in the form of liquid solutions, applied for example by soft brush, roller or by spraying. When dry, the insulator 13 is passed into a reducing-atmosphere oven, for example with an atmosphere containing hydrogen. In this way, the metallic salts are reduced and a thin layer of metal is formed on the areas A, B.

Silver can be used, for example, to form the metal layers, or a molybdenum and manganese alloy, but other metals or alloys can be used. The thickness of the metal layers 132, 133 is typically of the order of 5 to 50 μm.

The invention claimed is:

1. A plasma-generating spark plug which undergoes excitation in a radiofrequency domain, comprising:

a first metal electrode;

a second electrode which surrounds the first metal electrode; and an insulator located between the first metal electrode and the second electrode, and all of the surface of the insulator which faces the first metal electrode is metallized.

2. The plug as claimed in claim 1, wherein the first metal electrode is cylindrical and housed in a bore of the insulator.

3. The plug as claimed in claim 2, wherein the second electrode surrounds the insulator, the surface of the insulator facing the second electrode being metallized.

4. The plug as claimed in claim 1, wherein the insulator is made of ceramic.

5. The plug as claimed in claim 1, wherein the second electrode includes a recess into which the insulator is fitted with a gap.

* * * * *